United States Patent [19]

Ahrendt

[11] 4,345,995

[45] Aug. 24, 1982

[54] MAGNETIC SEPARATOR

[76] Inventor: James H. Ahrendt, E. 12114 Cataldo, #67, Spokane, Wash. 99206

[21] Appl. No.: 236,588

[22] Filed: Feb. 20, 1981

[51] Int. Cl.[3] ..... B03C 1/06

[52] U.S. Cl. ..... 209/219; 209/228

[58] Field of Search ..... 209/213, 215, 223 R, 209/223 A, 226, 636, 218, 219, 220, 212, 217, 228; 335/305, 306; 210/222, 223; 55/100; 366/127

[56] References Cited

U.S. PATENT DOCUMENTS

| | | | |
|---|---|---|---|
| 373,211 | 11/1887 | Wenstrow | 209/219 |
| 468,599 | 2/1892 | Ferraris | 209/219 |
| 487,074 | 11/1892 | Lovett | 209/219 X |
| 2,209,558 | 7/1940 | Bing | 335/306 X |
| 2,653,713 | 9/1953 | Siegal | 209/215 |
| 2,766,887 | 10/1956 | Atwood | 209/636 |
| 2,884,137 | 9/1958 | Grunel | 209/215 |
| 3,395,797 | 8/1968 | Haw | 209/223 R |
| 3,834,804 | 9/1974 | Bhagat | 209/223 A X |

FOREIGN PATENT DOCUMENTS

| | | | |
|---|---|---|---|
| 974187 | 11/1957 | Fed. Rep. of Germany | 209/219 |
| 1195734 | 3/1963 | Fed. Rep. of Germany | 210/222 |
| 191412 | 8/1966 | Fed. Rep. of Germany | 209/219 |
| 299136 | 10/1928 | United Kingdom | 209/223 R |
| 19254 | 8/1931 | United Kingdom | 209/223 R |

*Primary Examiner*—Ralph J. Hill
*Attorney, Agent, or Firm*—Keith S. Bergman

[57] ABSTRACT

A machine to separate magnetically susceptible particles from a particulate diamagnetic gangue in a batch type process especially as in ore benefication. A frame pivotally mounts a normally horizontally oriented processing pan that tilts to allow dumping of gangue. A cradle-like spindle plate support having two perpendicularly related rectangular spindle plates is pivotably mounted on the frame above the ore pan so that each spindle plate may be pivotably moved to service one-half of the ore pan. Each spindle plate carries a plurality of spacedly arrayed, perpendicularly oriented, eccentrically rotatable magnetic spindles that may be moved to an operative position within the processing pan. Leveling mechanism is provided to level ore within the pan and vibrators are associated with the pan to agitate particulate matter therein during processing. The uppermost portion of the frame movably supports two opposed vacuum pans, one of which may be moved into coincidence with each spindle plate to remove magnetically susceptible material captured by the magnetic spindles for recovery. Preferably the external surfaces of the magnetic spindles are formed of aluminum, especially for the processing of ores of platinum group metals.

8 Claims, 13 Drawing Figures

FIG. 1
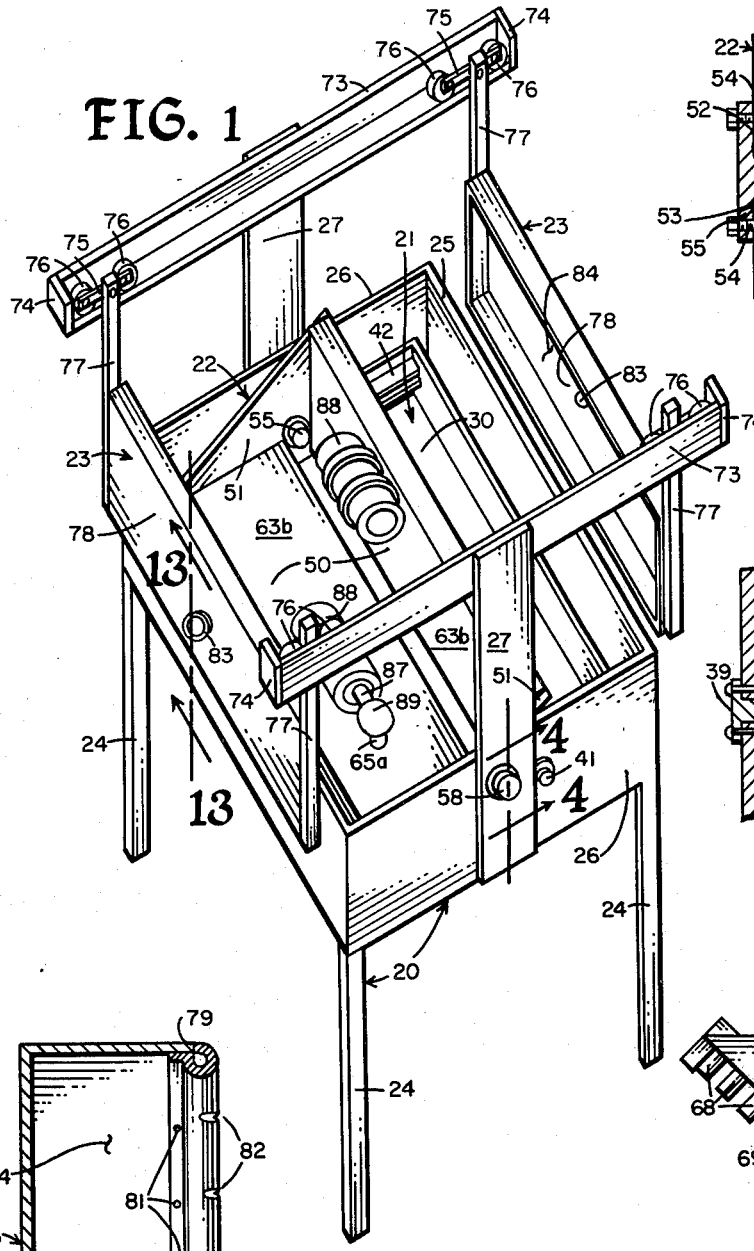
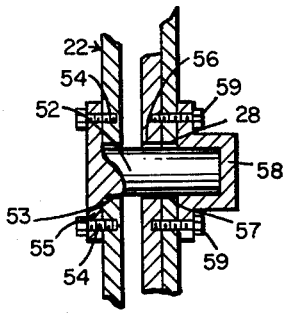
FIG. 4
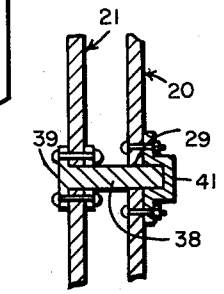
FIG. 8
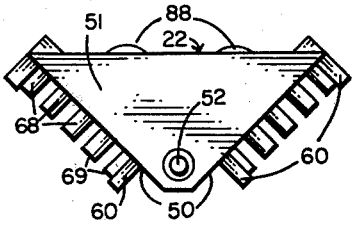
FIG. 3
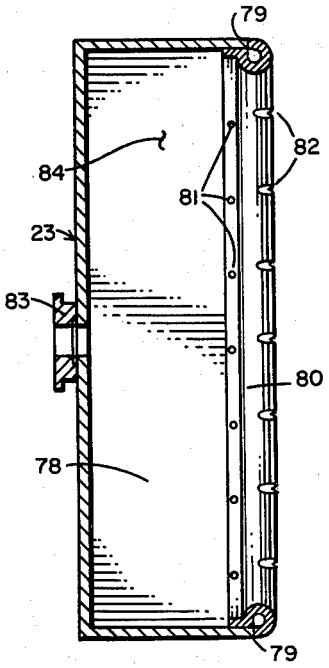
FIG. 13
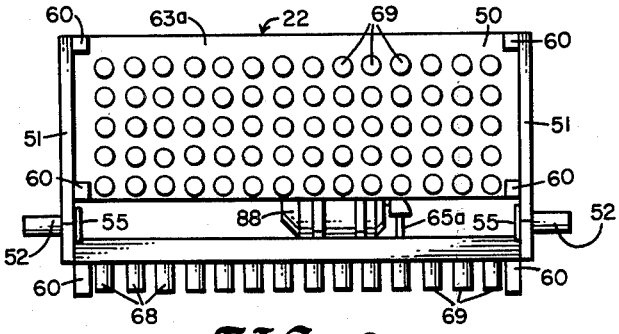
FIG. 2

MAGNETIC SEPARATOR

BACKGROUND OF INVENTION

1. Related Applications

There are no applications related hereto heretofore filed in this or any foreign country.

2. Field of Invention

My invention relates generally to the classifying and separating of magnetically susceptible particles from a diamagnetic particulate mass and more particularly to a machine that uses a plurality of eccentrically rotating cylinders so to do in a batch type process.

3. Description of Prior Art

The physical separation of ferromagnetic and paramagnetic particles from a diamagnetic particulate mass by use of magnetic forces has been long known and has been employed in the beneficiation of ores especially in dealing with materials of at least medial magnetic susceptibility. The instant invention provides a new and novel machine to apply such magnetic separating principles in a particular fashion, especially to beneficiate particulate ores carrying the platinum group of metals.

Magnetic separators, especially as used in ore processing, have been the subject of recent advancements which have made them quite sophisticated. In general, however, these known mechanisms have dealt largely with ferromagnetic materials that have strong magnetic susceptibility and are relatively inexpensive per unit of mass and therefore have been designed to deal with massive quantities of material by automated mechanisms that generally do not have finely controllable operating parameters. Most magnetic separators of present day commerce fall broadly into three distinguishable classes:

In a first class the material to be treated is spread in a thin layer on a horizontal belt and the more highly magnetically susceptible material is attracted away from the less magnetically susceptible material against the force of gravity to be thereafter carried away from the magnetic field for recovery. In a separator known as the Rowand-Wetherill mechanism, the magnetically susceptible material is carried away by a belt running at right angles to the travel of the feed belt. In another version of mechanism using this same principle the belt removing magnetically susceptible material runs in the same direction as the feed belt, parallel to it and under a series of magnets so that the magnetically susceptible material is carried along until it is outside of the field of the lower magnets and then dropped.

A second type of magnetic separator provides a horizontal feed belt passing around a magnetic pulley so that non-magnetic material will be dropped at the end of the belt whereas magnetically susceptible material will cling to the belt as it passes around the pulley and be dropped rearwardly of the pulley when that material leaves the magnetic field so that it can be there physically separated. This is the principle of the so-called Dings magnetic pulley which is used especially for the removal of tramp iron. Variations of this device may provide more sophisticated separations of particulate matter having various magnetic permeabilities by using a non-magnetic pulley, such as of brass, and placing fixed magnets in different circumferential locations so that the magnetically distinguishable material drops at specifically designated points and may there be separated.

A third common type of magnetic separator induces a highly concentrated magnetic force in a roller over which a horizontal belt carrying particulate matter passes so that the material falling in a downstream over it will have varying positioning depending upon the magnetic permeability. One or more lips may be inserted in the down falling particulate stream to separate material of different magnetic permeability. This same principle is applied in some mechanisms by placing a strong magnetic source laterally adjacent the downwardly falling stream of material so that magnetic permeable particles will be moved in a horizontal plane by the magnetic force and may be separated therebelow by reason of position.

All of these separators are of a continuous process type and generally do not provide any fine degree of either control or separation. Though these separators have been used for paramagnetic material other than ferromagnetic, and especially the platinum group of metals, they have not been particularly effective for this purpose, largely because of their lack of sophisticated control and the peculiar nature of the platinum group of metals-comprising platinum, iridium, osmium, ruthenium, rhodium and palladium. All of these metals are actually paramagnetic though rhodium and iridium are so low in their paramagnetism that they sometimes have been classified, even by authoritative sources, as diamagnetics. These particular metals are invariably intermixed in their occurrence and generally are difficult of chemical separation and nearly impossible of physical separation. The members of this group of metals interform solid solutions and various alloys, many of which may be intermixed either physically or possibly chemically. Depending somewhat upon crystal state it appears that each metal may under proper conditions be miscible in the other and most alloys do not have constant compositions. Commonly crystals of varying alloys may occur simultaneously in an intergrown fashion in a single material and it is commonplace to find minute grains of one alloy, measuring in the micron range, present in another. The magnetic properties of various chemical or physical mixtures of the platinum group metals are not necessarily predictable from the magnetic properties of their progenitors and in fact may differ widely therefrom. Nonetheless magnetic separation of various platinum metal compositions from ores remains one of the simplest and most effective methods of beneficiating these ores. The instant invention seeks to provide a mechanism to more effectively accomplish magnetic separation and recovery of both the platinum metals and other paramagnetics than could be accomplished by prior art devices.

I provide a batch type magnetic separator rather than a continuously operating mechanism to allow better control of time of magnetic separation and to allow longer elapsed periods for processing than may generally be had with the continuous dynamic systems.

Since the magnetic force exerted by a particular magnetic source varies as the square of the distance from that source it is important that magnetically susceptible materials to be separated are brought into contact or close association with the magnetic source. In this regard it should be remembered that the magnetic permeability through gangue between a magnetic source and magnetic particles may be substantially different, normally less, than the permeability through an air gap of the same distance. This is a substantial problem with the continuous dynamic processes of magnetic separation since it is generally difficult to maintain a thin stream of material in uniformly close adjacency to a magnetic source and because of this the efficiency of separation may be quite low. My invention solves this problem by providing a plurality of relatively small, magnetic cylinders rotating eccentrically in a horizontal bed of particulate material. Both the rotation of the surface of the magnetic cylinders and their eccentricity cause them to move adjacent particulate matter and to move their physical position relative to the particulate matter, both of which motions tend to increase the probability that an average particle will be brought much closer to a magnetic source than with the other dynamic separators. This action is especially beneficial in dealing with fine particles in the micron size range.

My invention also provides aluminum cylinders about the peripheral surface of its magnetic sources. It has been found empirically that this type of magnetic source is more efficient in magnetically separating the platinum group of metals and their mixture than other types of magnetic sources. The reason for this phenomenon is not definitely known but apparently the aluminum case about the magnetic cylinders act somewhat as a magnetic catalyst, similarly in the physical arena to the action of an ordinary catalyst in a chemical reaction. For whatever reason, it has been found that separation of platinum metals from their ores is substantially more efficient when magnetic cylinders having an aluminum periphery are used than when magnetic cylinders having a ferromagnetic surface are used.

My invention thusly differs from the prior art either individually or in combination in providing a new, novel and unique batch type magnetic separator.

SUMMARY OF INVENTION

My invention generally provides a frame pivotably supporting both a processing pan and a cradle-like spindle plate support immediately thereabove with paired opposed vacumn pans supported above and on either side of the spindle plate support to move thereto to remove entrapped magnetic material therefrom.

The frame is of a peripheral type that pivotably supports a rectilinear processing pan in a normally horizontal position, at a spaced distance above the surface supporting the frame, to allow for pan dumping to remove gangue therefrom. The cradle-like spindle plate support formed as a wedge with two perpendicular spindle plates each having the configuration of one-half of the ore processing pan, is pivotably mounted on the frame above the processing pan so that each spindle plate may be pivotably moved and supported parallel to and at a spaced distance above the bottom of one-half of the processing pan. Each spindle plate surface carries a plurality of relatively small, eccentrically rotatable cylindrical magnets or spindles projecting perpendicularly in spaced array from the outer plate surfaces.

Each of the spindles has a relatively thin peripheral shell of aluminum with strongly magnetic material on the inside and all are mounted and powered for eccentrically rotatable motion. Each plate of the spindle plate support may be magnetically pivoted into adjacency with the ore processing pan so that the spindles carried thereby rotate in material carried in the pan.

Vacumn pans are movably supported on each side of the spindle plate support by rail structures carried by the frame above the spindle plate support. The vacumn pans are substantially the same size and configuration as the spindle plates and movable thereover so that when a vacumn be applied thereto particulate matter carried by the magnetic spindles of the spindle plates may be moved from those spindles into a vacumn pan to be thence recovered from the associated vacumn system.

My invention provides batch processing wherein a measured charge of particulated ore is placed in the processing pan, first one side and then the other acted upon by magnetic spindles and any paramagnetic material recovered by the magnetic spindles removed therefrom by the vacumn pans for subsequent recovery, whereupon the diamagnetic gangue is discharged by tipping the processing pan.

In providing such a device it is:

A principle object to create a batch type processing machine to separate magnetically susceptible particles from a large mass of diamagnetic particulate matter.

A further object of my invention to provide such a device that has a plurality of relatively small, spacedly arrayed, magnetic spindles that eccentrically rotate in a particulate mass to very efficiently remove paramagnetic particles by bringing those particles into close proximity with the magnetic spindles.

A further object to provide such a device that has mechanical vibrators to vibrate particulate matter during processing to aid in moving particles into closer proximity with the magnetic spindles than they would move without vibration.

A further object to provide a device with such magnetic spindles having a periphery formed of aluminum which provides a more efficient recovery of platinum group metals from ores than if the cylinder periphery were formed of ferromagnetic or other material.

A further object of my invention to provide a batch type magnetic separator which allows better regulation of parameters effecting the separation and a more intricate contact of magnetic sources with more of the particulate matter to provide substantially greater efficiency than previously known continuous magnetic separators.

A still further object to provide such a device that may be used in the beneficiation of particulate ores without any essential requirement of either water or electricity for processing.

A still further object of my invention to provide such a device that is of new and novel design, of rugged and durable nature, of simple and economic manufacture and one otherwise well suited to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout;

FIG. 1 is an isometric view of my invention showing its various parts, their configuration and relationship.

FIG. 2 is an orthographic side view of the spindle plate support isolated from the remainder of the machine to show its details more clearly.

FIG. 3 is an orthographic end view of the spindle plate support of FIG. 2.

FIG. 4 is a partial, somewhat enlarged, cross-sectional view through the spindle plate support pivot structure, taken on the line 4—4 of FIG. 1 in the direction indicated by the arrows thereon.

FIG. 8 is a partial, somewhat enlarged cross-sectional view of the processing pan pivot structure taken on the line 8—8 of FIG. 1 in the direction indicated by the arrows thereon.

FIG. 13 is a somewhat enlarged, vertical, cross-sectional view of a vacumn pan of my invention taken on the line 13—13 of FIG. 1 in the direction indicated by the arrows thereon.

DESCRIPTION OF THE PREFERRED EMBODIMENT

Figure 9:
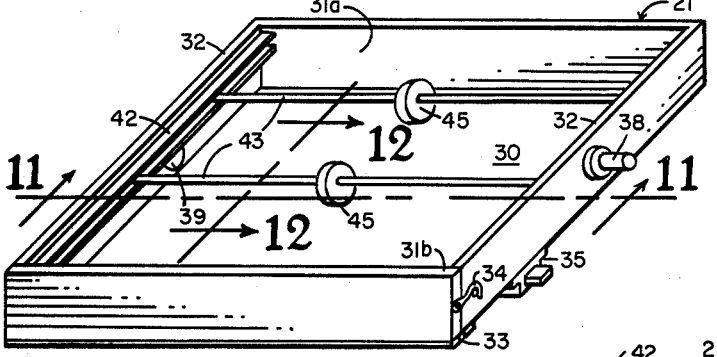
FIG. 9 is an isometric view of the processing pan isolated from the entire mechanism to show the details of its structure.
Figure 10:
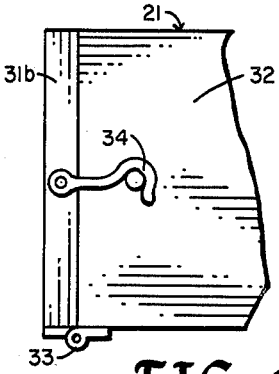
FIG. 10 is a somewhat enlarged view of the pivoting and fastening structure of the processing pan side which allows emptying of the pan during the dumping process.

My invention generally provides peripheral frame 20 pivotably mounting processing pan 21, at a spaced distance above the surface supporting the frame, and spindle plate support 22 immediately thereabove with opposed vacumn pans 23 movably carried by rails supported in the upper part of the frame above the spindle plate support to be movable into communicating therewith.

Frame 20 as seen particularly in FIG. 1 provides corner legs 24 structurally communicating with a rectilinear pan support formed by structurally communicating similar planar sides 25 and ends 26. Similar cooperating vacumn pan rail supports 27 extend upwardly from structural communication with the medial portion of each end 26 to support opposed cooperating vacumn pan rails in their uppermost parts. Ends 26 of the pan support of the frame each define cooperatively opposed spindle plate support shaft holes 28 in their medial part and pan shaft holes 29 somewhat laterally thereof to allow pivotable support of spindle plate support shafts and pan shafts.

The frame structure must be reasonably rigid, durable and of appropriate strength to fulfill its requirements. I prefer to form its elements from metal such as mild steel which admirably fulfills these requirements. Undoubtedly other rigid materials may be used for the purpose and if in the processing of ores to be found necessary that the frame be formed of diamagnetic material obviously other material will have to be used, but normally this is not the case.

Processing pan 21, as seen particularly in FIG. 9, provides the shallow rectilinear pan formed by bottom 30, similar sides 31 and similar ends 32. The bottom, ends 32 and side 31*a* are all structurally joined. Side 31*a* is pivotably mounted on bottom 30 by piano type hinge 33 and releasably positionally maintained by hook-pin structures 34 carried in each end part. At least one slide type latch 35 is carried by the pan bottom immediately inwardly adjacent an end to allow extension of its latch bar into hasp 36 carried in an appropriately receptive position by end 26 of the pan support to allow releasable maintenance of the pan in a substantially horizontal position. An appropriate orifice is provided in the end of the frame to allow passage of the latch bar.

At a spaced distance from latch 35, toward the middle of the pan, similar opposed pan jack axles 38 project outwardly from support by axle mounts 39 structurally carried by each pan end 32 as seen especially in the illustration of FIGS. 8 and 9. Appropriately positioned pan axle holes 29 are provided in each end 26 of the pan support to allow passage of the opposed cooperating pan jack axles for support in thrust bearings 41 structurally positioned on the pan support ends about pan axle holes 29. This structure provides a pivotable mounting of the processing pan on pan support frame 20, its normally horizontal maintenance relating thereto, and its release for tipping and opening for gangue dumping purposes.

Figure 11:
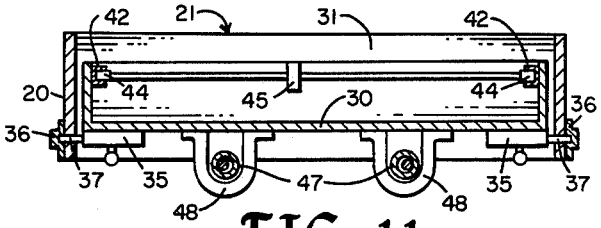
FIG. 11 is a transverse, cross-sectional view of the processing pan of FIG. 9 taken on the line 11—11 of that Figure in the direction indicated by arrows thereon to show particularly the vibrator structure in cross-section.

Preferably a leveling device as seen particularly in FIGS. 9 and 11 is provided to level material in the processing pan for more efficient operation of my machine, though it will operate without such a device. "U" shaped leveler rails 42 is provided parallel to and at a spaced distance below the top, and on each inner surface of pan ends 32. These leveler rails carry two leveling bars 43, one on each side of the spindle plate support axles extending between the opposed leveler rails and movably carried in the channel defined therein by wheels 44 rotatably mounted in each end part thereof. Each leveler bar is provided with at least one handle 45 extending upwardly therefrom to aid in manually manipulating the leveling bar to move it along the leveler rail to aid in leveling particulate material that may be deposited in somewhat of a pile in the medial part of the processing pan.

Figure 12:
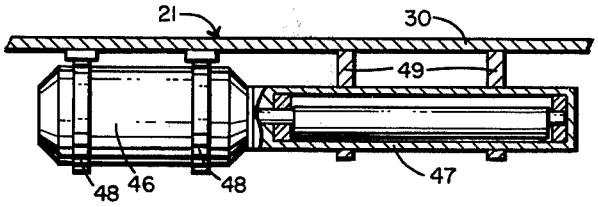
FIG. 12 is a partial, elongate, cross-sectional view of a vibrator taken on the line 12—12 of FIG. 9 in the direction indicated by the arrows thereon.

Vibrators are provided on the lower surface of bottom 30 of the processing pan to cause vibrations therein. I prefer two spaced, medially positioned eccentric vibrators, as illustrated particularly in FIGS. 11 and 12, each providing motor 46 communicating with elongate vibrator arm 47. This type of eccentric vibrator is well known in modern day commerce and therefore not described in any detail. Motor mounting brackets 48 extend from structural communication with the lower surface of bottom 30 about the motor and vibrator mounting brackets 49 extend from structural communication with bottom 30 about the elongate vibrator arm, all to appropriately mount the vibrator structure on the bottom element of the processing pan with appropriate rigidity to allow it to fulfill its purposes, Preferably the vibrators are aligned in spaced substantially parallel relationship in the medial portion of bottom 30 with their elongate axis substantially parallel to ends 32 of the processing pan to provide substantial vibration with minimal wear on the processing pan axles and bearings.

Figure 7:
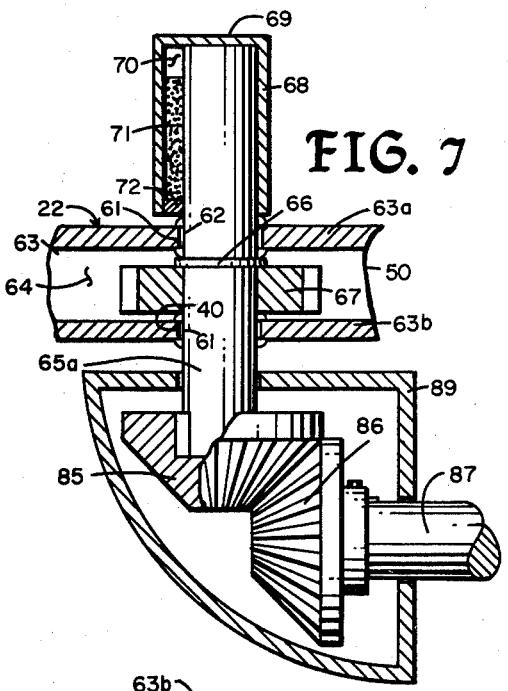
FIG. 7 is a view similar to FIG. 6 but of a driven magnetic cylinder to show the nature of the driving mechanism.
Figure 5:
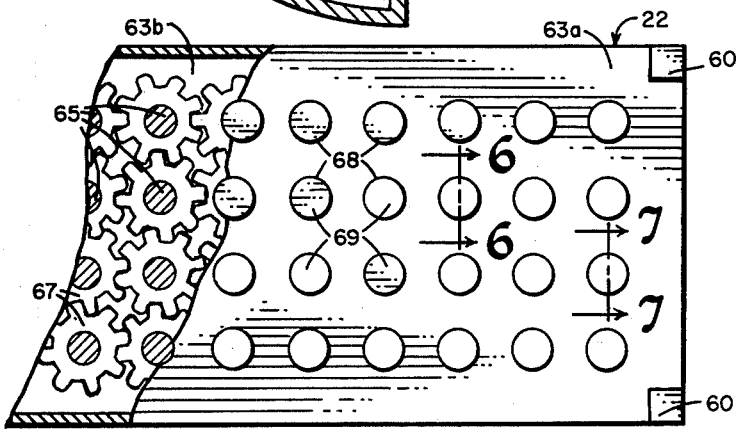
FIG. 5 is a somewhat enlarged, partially cut-away view of the spindle plate of FIG. 2, showing particularly the gear structure that drives the several magnetic cylinders.
Figure 6:
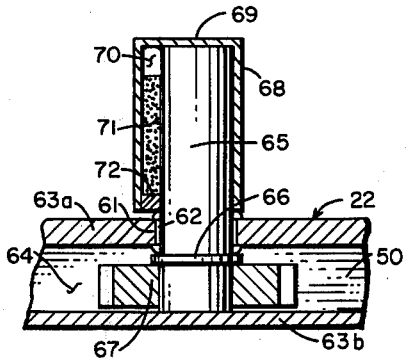
FIG. 6 is a still further enlarged partial, cross-sectional view of an individual magnetic cylinder taken on the line 6—6 of FIG. 5 in the direction indicated by the arrows thereon.

Spindle plate support 22 is shown in gross particularly in FIGS. 2 and 3 and in more detail in FIGS. 5, 6 and 7. It comprises a wedge-like structure formed with similar angularly disposed peripherally defined spindle plate 50 interconnected in substantially perpendicular relationship by sheet-like triangular support ends 51. The lower portions of the spindle plates, that is the portions near the support apex, are spaced from each other to provide a slot along the apex of the structure through which particulate matter might pass to enter the processing pen.

As seen particularly in FIG. 4 each spindle support end 51 in its lower or apex portion carries opposed cooperating support axles 52 to pivotably mount the support on the frame. These axles pass through holes 53 defined in the support ends and are fastened thereto by plural bolts 54 fastenably engaged between larger inner fastening bosses 55 of the axles and the adjacent portions of the end plates. The support axles pass through appropriately positionally defined holes 56, 57 in the ends 26 of the frame structure and vacumn pan rail supports respectively to be rotatably carried in thrust bearings 58 structurally carried on the outer surface of each vacumn pan rail support 27 by plural bolts 59 fastenably extending therebetween. This structure mounts the spindle plate support on the frame so that it is supported thereby and may be pivoted relative thereto.

Spindle plate support axles 52 and their ancillary structures are so positioned that a line through them is substantially parallel to and at a spaced distance above the medial line of the processing pan so that the support may be pivoted to allow either of the spindle plates to move into a position substantially parallel to and at a spaced distance above one-half of the bottom of the processing pan. Preferably at least one post-like pivot stop 60 projects normally outwardly from the face or outer surface of each spindle plate to prevent the plate from moving any closer to the processing pan then when the two be parallel. The distance between adjacent surfaces of spindle plate 50 and processing pan bottom 30 when parallel to preferably approximately one and a half inches in the form of invention illustrated. The size and configuration of each spindle plate is similar to but slightly smaller than one half of the processing pan when divided by a line running medially between and parallel to its sides.

Each spindle plate 50 has similar internal and external structures. Outer surfaces 63 are structurally interconnected to define internal chamber 64. Outer surfaces of each spindle plate defines plural spacedly arrayed magnetic cylinder axle holes 40 preferably carrying plastic bearings 61 about the inner surface thereof. The inner surface of the back spindle plate **63*b* provides a thrust bearing for the magnetic cylinder axis. Each magnetic cylinder axle bearing 62 rotatably carries one of the short cylindrical magnetic cylinder axles 65, each having boss 66 immediately inwardly adjacent plastic bearing 62 to positionally maintain the axle. The inner end portion of each axle 65 irrotatably carries cog type drive gear 67. These gears are so sized and configured to intermesh with similar gears carried by adjacent magnetic cylinder axles so that all are intermeshedly related such that if one be driven all will be moved in a similar rotary fashion. This structure requires symmetrical arrangement of the magnetic cylinder relative to each other; preferably the cylinders are arrayed on a grid equally spaced in two dimensions as illustrated particularly in FIG. 5**, to fulfill this requirement though undoubtedly other arrays may be used.

Each magnetic cylinder axle carries a peripherally defined magnetic cylinder 68 having structurally communicating end 69 in its outermost part. Magnetic cylinders 68 are of a diameter somewhat greater, approximately by one fourth, than the diameter of the magnetic cylinder axles and are mounted thereon with the cylinder axles immediately adjacent the inner surface of the magnetic cylinder 50 so that they will be eccentric to the axis of the cylinder axle and also leave inner space 70 between the outer surface of the cylinder axle and the inner surface of the magnetic cylinder. Magnetic cylinders 68 may be formed of either paramagnetic or diamagnetic material depending upon a particular process for which my invention is to be used. In its use in separating platinum group metals, however, it has been found that a magnetic cylinder formed of relatively thin sheet aluminum is more efficient than cylinders formed of ferromagnetic materials, apparently because the aluminum acts as somewhat of a physical catalyst in such magnetic extractions. The magnetic cylinders 68 are mechanically fastened in the position described relative the magnetic cylinder axles 65 which supports them preferably by adhesion. Space 70 defined between magnetic cylinders 68 and magnetic cylinder axle 65 is filled with some magnetic substance 71 of appropriate mass and magnetic characteristics to provide the magnetic parameters desired for a particular extraction process. Normally the material 71 will be ferromagnetic particles of some sort or other that are releasably maintained within the magnetic cylinders 68 by capping material 72, commonly a plastic or wax sealant, that adheres to the adjacent surfaces of both the magnetic cylinder and magnetic cylinder axle but yet can be removed.

The material from which spindle plate support 22 is formed must be of sufficient rigidity, durability and strength to fulfill its purpose. It may be a paramagnetic material such as iron or steel but for convenience of operation I prefer to form it of a diamagnetic metal such as brass, aluminum or bronze. If the structure be formed of paramagnetic material it may tend to form permanent magnetic zones in the material itself and these may tend to collect paramagnetic particles elsewhere than on the outer surface of magnetic cylinders 68. Such particles may be difficult to remove, depending on their nature and position. Some plastics may be usable for the spindle plate support if they possess the appropriate physical characteristics required.

Vacumn pan structure 23 is illustrated particularly in FIGS. 1 and 13, where it is seen that each vacumn pan rail support 27 of frame 20 carries in its upper part elongate, substantially horizontally extending cooperating vacumn pan tracks 73 having "L" shaped cross-section and stops 74 at each end. Vacumn pan trucks 75 are movably supported on the tracks by paired spaced pivotably mounted wheels 76. A pair of opposed cooperating trucks 75 each pivotably support depending vacumn pan arms 77 which rigidly mount a vacumn pan 78 therebetween in their largermost part. Each vacumn pan is substantially the same size and configuration as spindle plates 50 so that the vacumn pan may fit in operative communication with surface **63*a* of one of the mandrels. Peripheral rim 79 of the vacumn pan carries outwardly projecting resiliently deformable vacumn seal 80 mechanically attached thereto, in the instance illustrated by rivets 81. This vacumn seal element 80 provides a plurality of small air channels 82 in its outermost surface and is configured to fit against the periphery of surface 63***a* of a spindle plate in a nice fit with air from the ambient atmosphere able to enter through air channels 82. The depth of vacumn pan 78 must be such as to provide the fit described and accommodate the magnetic cylinders of a spindle plate in the chamber 84 defined therein. Back 78*a* of the vacumn pan provides fixture 83 to aid connection to an existing vacumn system. With this structure then a vacumn pan may be manually moved to cover the outer surface of either spindle plate 50 and when vacumn be applied therethrough there will be sufficient air flow about vacumn seal 80 through its air channels 82 to remove or aid in removing paramagnetic material collected on the magnetic cylinders of a spindle plate and carry such material outwardly through fixture 83 to a vacumn system from whence it may be reclaimed by well known methods.

The driving mechanism for magnetic cylinder axles is shown particularly in the illustration of FIGS. 1 and 7. Bearing hole 90 for one driven magnetic cylinder axle 65*a* extends through back 63*b* of each spindle plate 50 and the cylinder axle extends therethrough and for some distance therebeyond. This driven magnetic cylinder axle carries driven bevel gear 85 which emmeshedly engages driving bevel gear 86 irrotatably carried on driving axle 87 which is powered for rotary motion by motor 88. Normally, though not necessarily motor 88 will directly drive axle 87. Each motor 88 is supported in appropriate position on inner surface 63*b* of each spindle plate to drive the several magnetic cylinder axles carried by that particular plate. Preferably the driving mechanism is enclosed by cover 89 to keep environmental debris commonly associated with the magnetic apparatus out of the driving mechanism to aid in prolonging its life.

From the foregoing description of the structure of my invention its operation may be understood.

Firstly a machine is formed according to the foregoing specification and with appropriate configuration and dimension for a particular project. In the separation of platinum group metals from their particulated ores some of the dimensionings and materials used in my machine seem to be somewhat critical for most efficient operation. Preferably the magnetic cylinders should be approximately one quarter inch in diameter and one and one-half inches in length. Their spacing and eccentricity should be so regulated that the circle of revolution of each magnetic cylinder very nearly touches the circle of revolution of each of its adjacent neighbors. Again, for platinum group metal separation the magnetic cylinders should be formed of relatively thin aluminum. The strength of the magnetic field about each magnetic cylinder generated by the magnetic substance therein is not particularly critical, usually about a hundred maxwells, but the time of processing will vary somewhat inversely with the strength of the magnetic field. The speed of rotation of my magnetic cylinders and of the vibrators is not particularly critical but again, the time of separation will vary somewhat inversely with the speed of rotation of each system. The rotation speed of either, however, should not be as great as to create sufficient disturbance to cause particulate matter to exit from the semi-enclosed processing portion of the processing pan, that is, from within the vertical containment of its sides. I normally prefer a rotational speed for magnetic cylinders, of the size and eccentricity specified, of approximately 300 rpm and a rotary vibrator speed of approximately the same magnitude. For greatest convenience of operation both motors 46 which drive the vibrators and motors 88 which drive the magnetic cylinders will be of a variable speed type.

To use my device a pre-measured charge of particulate matter is placed in processing pan 21 normally by deposition through the medial slot between spindle plates 50. This charge of material will have been particulated by known processes to about a three hundred twenty five mesh size, though the actual sizing of the particulate matter varies in individual cases and according to well known principles of mineral dressing. Oftentimes various mineral components may be separated by appropriate sizing of ore and again, if the particle size be too large my separator may not be efficiently operative because the particles either have too weak a magnetic attraction to be moved through the particulate mass to be separated, their bulk may keep them from moving in the particulate mass or their mass may allow gravity forces to overcome magnetic forces. Normally, however, for ordinary platinum group metal ores a Three Hundred Twenty Five mesh size is necessary to provide efficient operation.

The volume of the particulate charge should be predetermined to fill the processing pan to a uniform depth slightly less than the length of the projection of the magnetic cylinders away from the face or outer surface of the spindle plates. With one and a half inch magnetic cylinders this depth should be approximately one and one quarter inches. Once the charge is placed in the processing pan, leveling bars 43 are manually moved to somewhat level the charge over the surface of the processing pan to a somewhat uniform depth. It should be noted in this regard, however, that during the processing operations both the eccentric rotation of the magnetic cylinders and the vibration of the pan will tend to level the particulate matter during processing to a fairly uniform depth.

After placement of a particulate charge in the processing pan the vibrator motors are started to vibrate the pan and the magnetic cylinder motors are started to rotate the magnetic cylinders. The spindle plate support is then pivoted so that one of the spindle plates is in its downwardmost position substantially parallel to and at a spaced distance above the processing pan. In this position the magnetic cylinders will rotate in the particulate matter to very nearly their length. The vibration of the processing pan and the rotation of the magnetic cylinders will cause motion in the particulate matter and this motion will tend to move the particulate relative to each other and increase the probability of closeness of association of the maximum number of particles with the surface of the magnetic cylinders, all to maximize the magnetic separation of contained paramagnetic particles. After appropriate processing has been had in one side of the pan by one spindle plate, the support is pivoted approximately ninety degrees and the same operation carried out in the other half of the pan by the spindle plate. The length of time of processing and other parameters concerning the magnetic separation generally have to be determined empirically in each particulate instance with a particular type of ore. In general, however, with ores of the platinum group metals particulated to the Three Hundred Twenty Five mesh range processing times for batches specified are approximately six minutes and with such timing a machine having a pan time of approximately fifteen feet can process about four tons of particulate matter in an eight hour period.

After the processing of particulate material by one spindle plate, and normally during processing by the other spindle plate, the vacumn pan servicing the non-processing spindle plate carrying particulate matter is moved into vacumn communication with that non-processing plate and a vacumn applied thereto to remove the paramagnetic material carried in the external surfaces of the magnetic cylinders. This paramagnetic material is removed through the vacumn system and separated therefrom by any of the various processes hereinbefore known to remove such matter from the effluent of a vacumn system.

After the entire processing pan of ore has been processed and the paramagnetic material removed from the plates, slip latch 35 is released to allow the processing pan to tilt and hook-pin combination 34 is released to allow the pan side to open to dump the charge of gangue carried therein vertically downwardly to a position from which it may be received by a conveying system (not shown) and removed according to principles and practices heretofore well known in the ore processing arts. The side of the processing pan is then re-established and the pan re-positioned in its normally horizontal position where it is maintained by the latch, ready to accept the next batch of material to be processed.

From the foregoing description it is to be particularly noted that although my machine is described for use particularly in the beneficiation of ores of the platinum group metals, it well may be used for treating and processing other particulate materials where it be desired to separate paramagnetic particles from a larger diamagnetic particulate mass.

It is further to be noted that the motors involved in my invention may be replaced by known manual mechanism or powered by petroleum or other means and if so done the mechanism does not require the use of either water or electricity for its operation and therefore may be readily used in areas where neither water or electricity are available.

The foregoing description of my invention is necessarily of a detailed nature so that a specific embodiment of it might be set forth as required but it is to be understood that various modifications of detail, rearrangement and multiplication of parts may be resorted to without departing from its spirit, essence or scope.

Having thusly described my invention, what I desire to protect by Letters Patent, and what I claim is:

1. A machine for separating paramagnetic particles from a particulate mass containing substantially more diamagnetic particles, comprising in combination:

a frame providing a peripherally defined pan support at a spaced distance above a horizontal frame supporting surface;

a processing pan pivotably supported in the pan support in a normally horizontal position but releasably pivotable for dumping;

a spindle plate support having two substantially perpendicularly related spindle plates pivotably mounted on the frame above the pan support in such position that each spindle plate is pivotable to a position substantially parallel to and at a spaced distance above opposite halves of the processing pan, each of said spindle plates having;

a plurality of spacedly arrayed elongate rotatable magnetic cylinders extending substantially perpendicularly from its processing pan facing surface, and means of rotating said cylinder; and means of removing separated paramagnetic particulate matter from the magnetic cylinders.

2. The invention of claim 1 further characterized by: the processing pan having at least one mechanical vibrator mounted on it to cause vibration therein.

3. The invention of claim 1 further characterized by: the periphery of the magnetic cylinders being formed of aluminum.

4. The invention of claim 1 further characterized by the means of removing paramagnetic particulate matter from the magnetic cylinders comprising:

paired opposed magnetic pans movably supported by the frame laterally and above the spindle plate support for motion into vacumn communication with the magnetic cylinder carrying face of each spindle plate;

means of supplying a vacumn to the vacumn pans; and means of recovering particulate matter from the vacumn system after its removal from the magnetic cylinders.

5. The invention of claim 1 further characterized by each spindle plate having:

magnetic cylinders positioned in spaced, rectilinear array with each magnetic cylinder supported eccentrically on a magnetic cylinder axle, each of said axles irrotatably carrying a gear intercommunicating with at least one of the gears carried by an adjacent magnetic cylinder axle, and means of rotating one of said magnetic cylinder axles to thereby rotate all magnetic cylinders.

6. A machine for separating paramagnetic particles from a particulate mass containing substantially more diamagnetic particles, comprising in combination:

a frame supporting a peripherally defined pan support at a spaced distance above a frame supporting surface with opposed vacumn pan rail supports extending upwardly from the medial part of opposed sides of the pan support;

a processing pan pivotably and releasably supported in the pan support in a substantially horizontal position but pivotably movable for dumping contained particulate matter, said processing pan having;

means to aid the dumping of particulate matter, and means of leveling particulate matter in the processing pan;

a spindle plate support having two substantially perpendicularly related spindle plates joined in their ends by rigid end plates with a space between spindle plates, pivotably mounted on the pan supports above the processing pan in position such that each spindle plate is pivotable to a position substantially parallel to and at a spaced distance above one half of the processing pan, each spindle plate having a plurality of spacedly arrayed rotatable magnetic cylinders extending from the processing pan facing surface to a spaced distance from the surface of the processing pan when a spindle plate be parallel thereto, and means of rotating said magnetic cylinders; and paired opposed vacumn pans configured to fit with vacumn contact over the magnetic cylinder carrying surface of each spindle plate, movably carried between two opposed, cooperating substantially horizontal vacumn pan rails, one of said rails carried by the upper part of each of the vacumn pan rail supports, each vacumn pan movable to vacumn contact with the magnetic cylinder carrying face of one spindle plate having means to allow limited air flow into the vacumn pan to allow removal of particulate matter carried by the magnetic cylinders, and means of supplying vacumn to each vacumn pan and of recovering paramagnetic particulate matter from the vacumn system.

7. The invention of claim 6 further characterized by:

at least one mechanical vibrator carried by the processing pan to cause vibration therein; and the magnetic cylinders of each spindle plate positioned in spaced rectilinear array with each magnetic cylinder including a cylindrical peripheral shell supported eccentrically on a magnetic cylinder axle irrotatably carrying a gear to intercommunicate with gears of adjacent magnetic cylinder axles to transmit rotary motion of one driven axle to all magnetic cylinder axles.

8. The invention of claim 7 further characterized by the magnetic cylinders being formed of relatively thin aluminum metal.

* * * * *